US011015400B2

(12) United States Patent
Horn

(10) Patent No.: US 11,015,400 B2
(45) Date of Patent: May 25, 2021

(54) APPARATUS FOR TRANSMITTING TORQUE THROUGH A WORK STRING

(71) Applicant: DELTATEK OIL TOOLS LTD., Aberdeen (GB)

(72) Inventor: Tristam Horn, Aberdeen (GB)

(73) Assignee: DELTATEK OIL TOOLS, LTD., Aberdeen (GB)

( * ) Notice: Subject to any disclaimer, the term of this patent is extended or adjusted under 35 U.S.C. 154(b) by 0 days.

(21) Appl. No.: 16/328,898

(22) PCT Filed: Aug. 7, 2017

(86) PCT No.: PCT/GB2017/052324
§ 371 (c)(1),
(2) Date: Feb. 27, 2019

(87) PCT Pub. No.: WO2018/042148
PCT Pub. Date: Mar. 8, 2018

(65) Prior Publication Data

US 2019/0218865 A1 Jul. 18, 2019

(30) Foreign Application Priority Data

Aug. 31, 2016 (GB) ..... 1614720

(51) Int. Cl.
*E21B 17/05* (2006.01)
*E21B 17/08* (2006.01)
*E21B 41/00* (2006.01)

(52) U.S. Cl.
CPC ..... *E21B 17/05* (2013.01); *E21B 17/08* (2013.01); *E21B 17/085* (2013.01); *E21B 41/0007* (2013.01)

(58) Field of Classification Search
CPC ..... E21B 17/05; E21B 17/08; E21B 17/085; E21B 41/00
See application file for complete search history.

(56) References Cited

U.S. PATENT DOCUMENTS 3,156,310 A * 11/1964 Frisby ..... E21B 7/062 175/76
3,345,087 A * 10/1967 Hanes ..... F16L 25/02 285/39

(Continued)

FOREIGN PATENT DOCUMENTS

CN 2866789 2/2007
EP 1878524 7/2007

(Continued)

OTHER PUBLICATIONS

UK IPO Combined Search and Examination Report, Application No. GB1614720.9 dated Jan. 26, 2017, pp. 1-7.

(Continued)

*Primary Examiner* — Aaron L Lembo
(74) *Attorney, Agent, or Firm* — David Bradin; Nexsen Pruet, PLLC

(57) ABSTRACT

An apparatus for transferring rotational torque from a work string to a subsea infrastructure, said apparatus comprising a first connection (1) for receiving the work string; a second connection (6) for receiving the subsea infrastructure tooling; a joint seat (5) located between the first connection (1) and the second connection (6); a joint body (3) provided on the joint seat (5), wherein the joint body (3) is connected to the second connection (8) and wherein the joint body (3) can articulate freely within the joint seat (5); and means for transferring rotational torque from the first connection (1) to the joint body (3) and subsequently to the second connection (6).

10 Claims, 14 Drawing Sheets

(56) References Cited

U.S. PATENT DOCUMENTS

| | | | | |
|---|---|---|---|---|
| 3,670,830 | A * | 6/1972 | Van Der Wijden | E02F 3/9212 175/52 |
| 3,855,884 | A | 12/1974 | McPeak | |
| 4,452,472 | A * | 6/1984 | Crase | E21B 4/02 285/18 |
| 4,479,669 | A * | 10/1984 | Hynes | E21B 17/046 285/332.3 |
| 4,776,727 | A * | 10/1988 | Saffrhan | E21B 41/04 405/225 |
| 5,868,524 | A * | 2/1999 | Martin | E21B 17/085 405/170 |
| 6,105,473 | A | 8/2000 | Huang | |
| 8,210,265 | B2 * | 7/2012 | Alikin | E21B 17/085 166/345 |
| 8,995,225 | B2 * | 3/2015 | Nyholt | G10K 11/004 367/104 |
| 10,590,744 | B2 * | 3/2020 | Liess | E21B 17/046 |
| 2011/0048710 | A1 | 3/2011 | Robichaux et al. | |
| 2012/0267116 | A1 * | 10/2012 | Anderson | E21B 19/16 166/340 |
| 2012/0312600 | A1 | 12/2012 | Abbasi | |
| 2014/0069657 | A1 * | 3/2014 | Povloski | E21B 17/015 166/345 |
| 2016/0258228 | A1 * | 9/2016 | Thomas | E21B 47/07 |
| 2018/0305992 | A1 * | 10/2018 | Bouaphanh | E21B 43/0107 |

FOREIGN PATENT DOCUMENTS

| | | |
|---|---|---|
| GB | 1496435 | 12/1977 |
| GB | 2107815 | 5/1983 |
| WO | 2006/109090 | 10/2006 |
| WO | 2014/107813 | 7/2014 |
| WO | 2014/151518 | 9/2014 |

OTHER PUBLICATIONS

UK IPO Examination Report, Application No. GB1614720.9 dated Jun. 29, 2017, pp. 1-5.
UK IPO Examination Report, Application No. GB1614720.9 dated Aug. 29, 2017, pp. 1-4.
UK IPO Examination Report, Application No. GB1614720.9 dated Aug. 8, 2018, pp. 1-3.
PCT International Search Report and Written Opinion for International Application No. PCT/GB2017/052324, dated Oct. 20, 2017, pp. 1-4.

* cited by examiner

SECTION B-B

SECTION A-A

DETAIL A

DETAILA

SECTION B-B

SECTION D-D

SECTION C-C

SECTION B-B

SECTION D-D

SECTION C-C

SECTION H-H

SECTION F-F

SECTION E-E

SECTION B-B

SECTION A-A

SECTION B-B

SECTION A-A

APPARATUS FOR TRANSMITTING TORQUE THROUGH A WORK STRING

This application is a National Stage Application under 35 U.S.C. 371 of PCT Application No. PCT/GB2017/052324, filed Aug. 7, 2017, which claims priority to GB Application No. 1614720.9, filed Aug. 31, 2016. The disclosures of each of these documents is hereby incorporated by reference in its entirety for all purposes.

FIELD OF THE INVENTION

The present invention relates to an apparatus for use in the oil and gas industry, particularly for subsea operations on offshore drilling rigs within a work string. The present invention also relates to a lockable feature for preventing transfer of a bending moment.

BACKGROUND

Casing strings and subsea infrastructure are installed into or on to subsea oil and gas wells to facilitate the production of hydrocarbons from subsurface reservoirs. The equipment is installed by means of a work string made up of numerous sections of steel tubular components, commonly referred to as a landing string.

The work string or landing string may be attached to the top of a casing string or subsea infrastructure via a running tool which may require rotational torque to be transmitted through the string to make up the connection and to break out the connection. Rotational torque may be required to be transmitted through the work string into the casing string or subsea infrastructure to align the equipment with a desired orientation once at the installed depth or to aid in getting the casing to the desired depth.

The work string may be used as a conduit for pumping fluids and/or objects through the casing string or subsea infrastructure. The fluids may be, but are not limited to: seawater, drilling mud and cement slurry. The objects may be, but are not limited to: cement wiper darts and tool activation darts or balls. The work string therefore must have internal bore pass through free from square shoulders causing potential obstructions for objects, and pressure retaining ability including all constituent components.

In the case of certain geographical locations, it is required to stop installation operations until sufficiently benign environmental conditions are available to install casing strings and subsea infrastructure. This may be due to sea current and/or wave force loading onto the casing strings and the subsea infrastructure causing damage to the work string via large amplitude bending moments being transferred through the connection to the work string.

In the instance of operations having been stopped to mitigate risk of damage to the work string via bending moment transfer, a need for a work string component which provides rotational torque to enable engagement and disengagement of some running tools, and achieving desired orientation of infrastructure, whilst not transferring a bending moment to the work string is necessary.

SUMMARY OF THE INVENTION

There is provided an apparatus for transferring rotational torque from a work string to a subsea infrastructure, the apparatus comprising a first connection for receiving the work string; a second connection for receiving the subsea infrastructure tooling; a joint seat located between the first connection and the second connection; a joint body provided on the joint seat, wherein the joint body is connected to the second connection, and wherein the joint body can articulate freely within the joint seat; and means for transferring rotational torque from the first connection to the joint body and subsequently to the second connection.

The apparatus may further comprise a central axis defined from the first connection to the second connection, and wherein the joint body can rotate about the central axis. The joint body may rotate 360 degrees about the central axis.

In a further embodiment, the joint body may pivot away from, or towards, the central axis in any orientation about the central axis.

The means for transferring rotational torque may comprise at least one drive pin provided between the joint body and the joint seat.

Alternatively, the means for transferring rotational torque may comprise at least one spline portion located on the joint body, said spline portion being received in a recess provided in the joint seat.

In another embodiment, the means for transferring rotational torque may comprise a torque key provided in a receptacle located in the first connection and in a recessed groove located in the joint body In a preferred embodiment, the first connection is a box connection.

In a preferred embodiment, the second connection is a pin connection.

Preferably, the apparatus is made of steel, hardened plastics or carbon fibre. Preferably, the steel is one of AISI/SAE 4140, X56, L80, P110, Q125, S135 or V150.

There may also be provided a locking mechanism for the apparatus described above, the locking mechanism may comprise: a sleeve configured to fit over the first connection and the joint seat; at least one locking pin that is adapted to engage the joint seat and/or joint body such that, when in a locked position, the joint body does not move freely and, when in an unlocked position, allows the joint body to move freely.

The locking mechanism may further comprise at least one handle for operating the at least one locking pin.

Preferably, the at least one locking pin and the at least one handle are a Remote Operated Vehicle locking pin and a Remote Operated Vehicle handle.

In a preferred embodiment, the sleeve, the at least one locking pin and the at least one handle are made from steel, carbon fibre or hardened plastics. Preferably, the steel is one of AISI/SAE 4140, X56, L80, P110, Q125, S135 or V150.

There is also provided a kit comprising: the apparatus as described above; and the locking mechanism as described above.

DETAILED DESCRIPTION OF THE INVENTION

Figure 2:
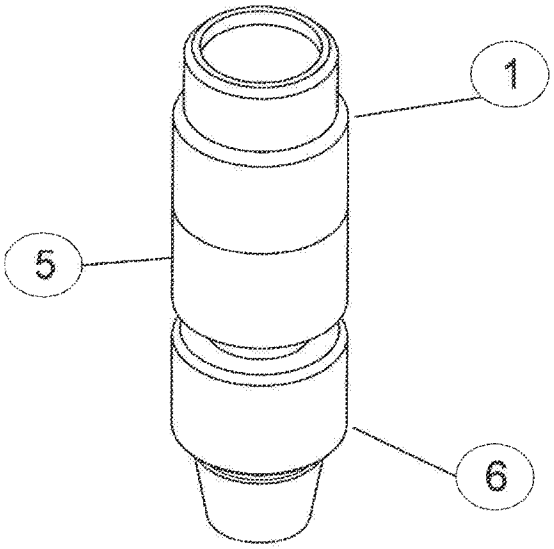
FIG. 2 shows an assembled view of the apparatus of FIG. 1.

Generally an apparatus which enables installation operations of casings and subsea infrastructure to be carried out with a work string is disclosed.

A typical installation operation of a casing string first involves the assembly of the casing string from the drilling unit, whereby many individual sections of tubular are attached together by means of a connection to create the full length of the casing string from the total depth of the section drilled into the subsurface formation, back to the wellhead, which for subsea wellhead systems is typically at the seabed.

With subsea wellhead systems used to construct offshore oil and gas wells, a running tool is required to be connected to the top of the casing string when running conductor (first casing string for structural support of the rest of the well), surface casing (a subsequent casing string run with the wellhead on the top), and any intermediate liner strings (a liner is a casing string where the top is below the wellhead depth). This running tool is then run down through the seawater to the intended setting depth on a work string, commonly referred to as a landing string. This setting depth for subsea wellhead systems is typically at the seabed, which depending on the water depth at the well site can be as much as many thousands of metres below sea level.

When installing subsea infrastructure from a mobile offshore drilling unit, such as, but not limited to, hydrocarbon production or water injection manifolds, hydrocarbon or water flow bases and subsea Christmas trees, a running tool is typically connected to the subsea infrastructure to facilitate connecting a work string to, and running the infrastructure through the seawater from the drilling unit to the intended final location, typically on the seabed. The installation can then be completed, the running tool released and recovered by recovering the work string with the running tool.

The connection between the running tool and the bottom of the landing or work string is typically one which is subjected to a large force due to environmental conditions loading the casing string or subsea infrastructure, and transferring that force into the landing string. This force can be as a result of, but not limited to, high wave or current motion. This force can limit the conditions in which the casing string or subsea infrastructure can be run through the sea surface in order to prevent damage and failure of the connection.

The object of the present invention is to provide an apparatus that enables rotational torque to be transmitted from above the apparatus to below the apparatus, whilst enabling no bending moment to be transmitted from below the apparatus to above the apparatus by means of a flexible joint. In the same instance, the apparatus has a large bore internal diameter to facilitate passing of objects through the internal diameter, whereby internal components can be shaped with a chamfered lead-in circumferentially to prevent inadvertent hang up features for objects passing through, and maintain internal pressure retaining ability. There is also provided a locking mechanism that includes a locking sleeve which if desired can be used to lock the tool in a rigid state in order to prevent articulation of the apparatus.

Figure 1:
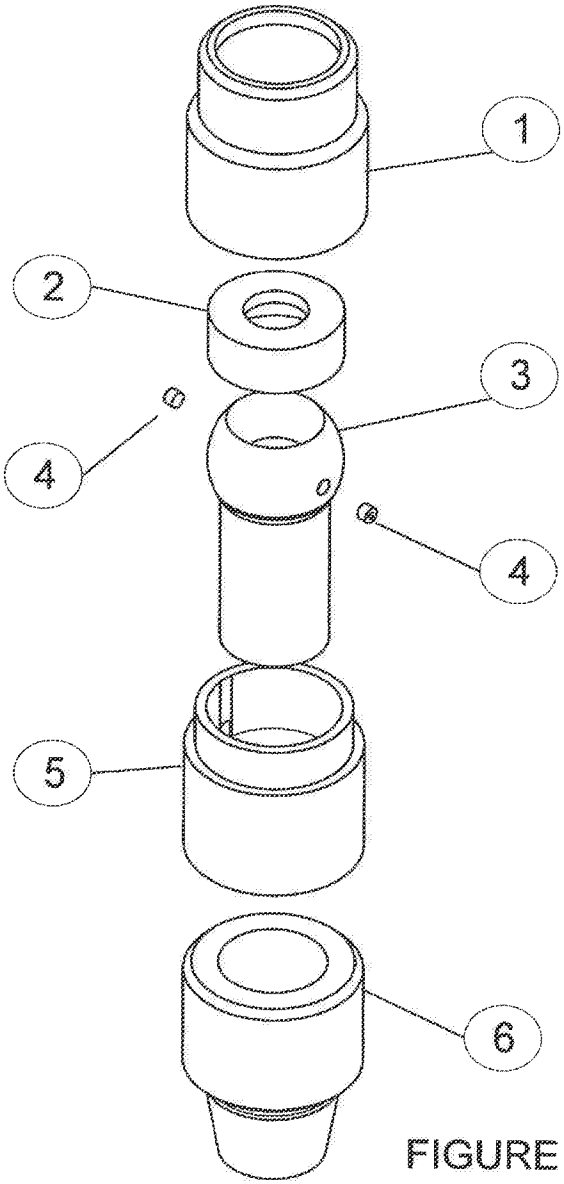
FIG. 1 shows an apparatus in an exploded view in accordance with an embodiment of the present invention.

FIG. 1 shows an exploded view of an example of the apparatus that enables the transmission of rotational torque. As shown in FIG. 1, the apparatus may include a box connection 1 for connecting the apparatus to a landing or work string (not shown), a retainer ring 2, a pivot joint body 3, a pivot joint seat 5, drive pins 4 and a pin connection 6 used to connect to the running tool to install the casing or subsea infrastructure.

During running of the casing string or subsea infrastructure through the sea surface, environmental loading causing a force to be imparted into the running tool and through the apparatus of FIG. 1 is able to disturb the pin connection 6, which is attached to the pivot joint body 3, which is therefore also disturbed. The pivot joint body 3 is able to articulate freely within the pivot joint seat 5—i.e., the pivot joint body 3 has sufficient space when located in the pivot joint seat 5 such that the pivot joint body 3 can articulate freely. The apparatus of the present invention has a central axis leading in a longitudinal direction from the box connection 1 to the pin connection 6. In an embodiment of the present invention, the combined components when assembled can rotate 360 degrees about this central axis. Further, the pivot joint body 3 can pivot away from (or towards) the central axis. The pivot joint body 3 can pivot away from, or towards, the central axis by preferably 15 degrees. However, it is to be understood that the pivot joint body 3 can pivot away from, or towards, the central axis by any number of degrees that are above and below 15 degrees. Therefore, the pivot joint body 3 does not transfer any bending moment as a result of load through the apparatus in the box connection 1 or pin connection 6. In the example shown, the pivot joint body 3 is spherical, and the pivot joint seat 5 includes a shaped portion to receive the pivot joint body 3. As mentioned above, the shaped portion of the pivot joint seat 5 may provide a gap between the pivot joint body 3 and the pivot joint seat 5 such that the pivot joint body 3 can articulate freely. Alternatively, the pivot joint body 3 may fit snugly in the pivot joint seat 5, but be provided with lubricant/oil between the pivot joint seat 5 and pivot joint body 3 such that the pivot joint body 3 can articulate freely.

The apparatus shown in FIG. 1 may also include a drive pin 4, and may have one or more drive pins 4. The drive pin 4 is of a shape that can be, but is not limited to, one or more of a combination of cylindrical, spherical, part-spheroid, hemisphere, chamfered cylinder and filleted cylinder that interfaces within a recessed groove provided in the pivot joint seat 5. The recessed groove of pivot joint seat 5 is of a similar shape to that of the drive pin 4. As the drive pin 4 is provided in the recessed groove of the pivot joint seat 5, this prevents free rotation of the pivot joint body 3 relative to the pivot joint seat 5. The drive pin 4 must be of a shape that allows rotation about its axis within the groove in the pivot joint seat. The drive pin 4 can or cannot be positively connected to the pivot joint body 3.

During purposeful rotation of the work string from above to impart a rotational torque force through the apparatus, the box connection 1 transfers the rotational torque into the pivot joint seat 5, which transfers rotational torque force via the groove in the pivot joint seat 5 into the drive pin 4 which is positioned in the groove. The drive pin 4 transfers rotational torque into the pivot joint body 3 and then through the pin connection 6.

The pivot joint body 3 may also include a bore that allows for objects and/or fluid to run through from the box connection 1 and pin connection 6. The bore can be shaped to include a chamfer on the internal upper face to optimise the ability to pass objects through the bore. Therefore, the bore of pivot joint body 3 allows for a continuous conduit from a work or landing string to a casing or subsea infrastructure.

FIG. 2 shows the assembled components of FIG. 1. As can be seen in this Figure, the box connection 1 connects to the pivot joint seat 5. The pivot joint body 3 (not shown in FIG. 2) allows for connection to the pin connection 6.

The assembled apparatus of FIG. 2 is also shown in more detail in FIGS. 3-10.

Figure 3:
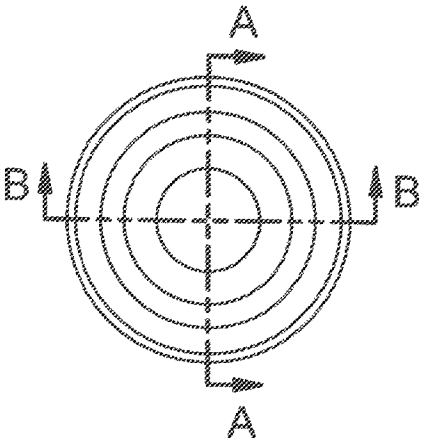
FIG. 3 shows the apparatus of FIG. 2 viewed from above.

FIG. 3 shows a top view of the assembled apparatus if FIG. 2 with sections A-A and B-B labelled.

Figure 4:
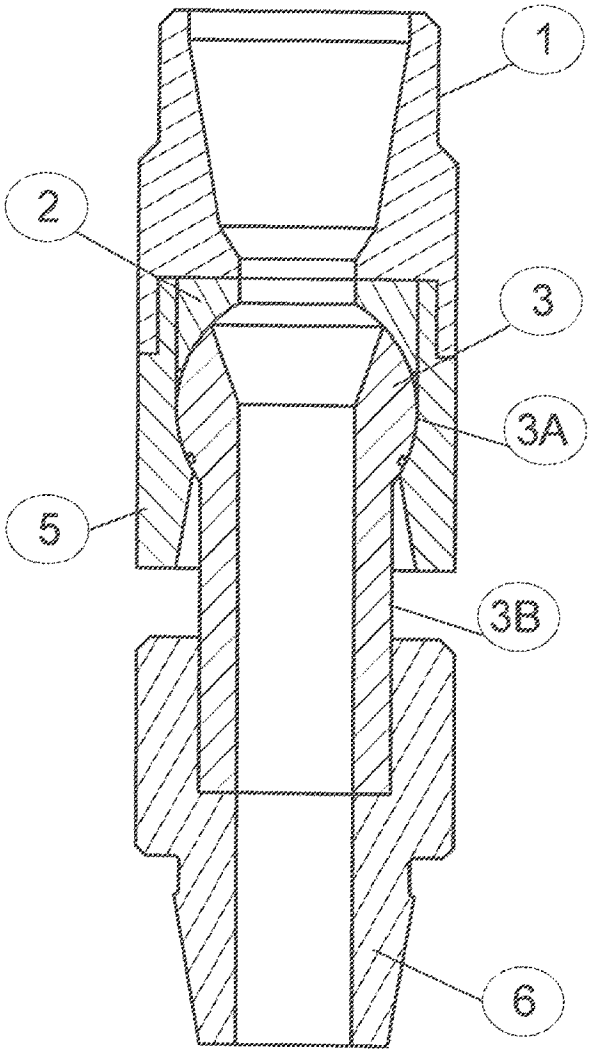
FIG. 4 shows a section view of section A-A of the apparatus.

FIG. 4 shows a cross-sectional view of the apparatus along the section A-A. In the example shown here, the connected components are shown. As can be seen in this Figure, there may be provided the box connection 1, a retainer ring 2 located between the box connection 1 and the pivot joint seat 5. The pivot joint body 3 is located between the retainer ring 2 and the pivot joint seat 5. The retainer ring 2 keeps the pivot joint body 3 located in the pivot joint seat 5. The pivot joint body 3 has a spherical head 3A and an elongated body 3B extending from the spherical head 3A so as to be connected to the pin connection 6. Of course, the head 3A may be of the form of any shape that allows for free articulation of the pivot joint body 3 within the apparatus.

Figure 5:
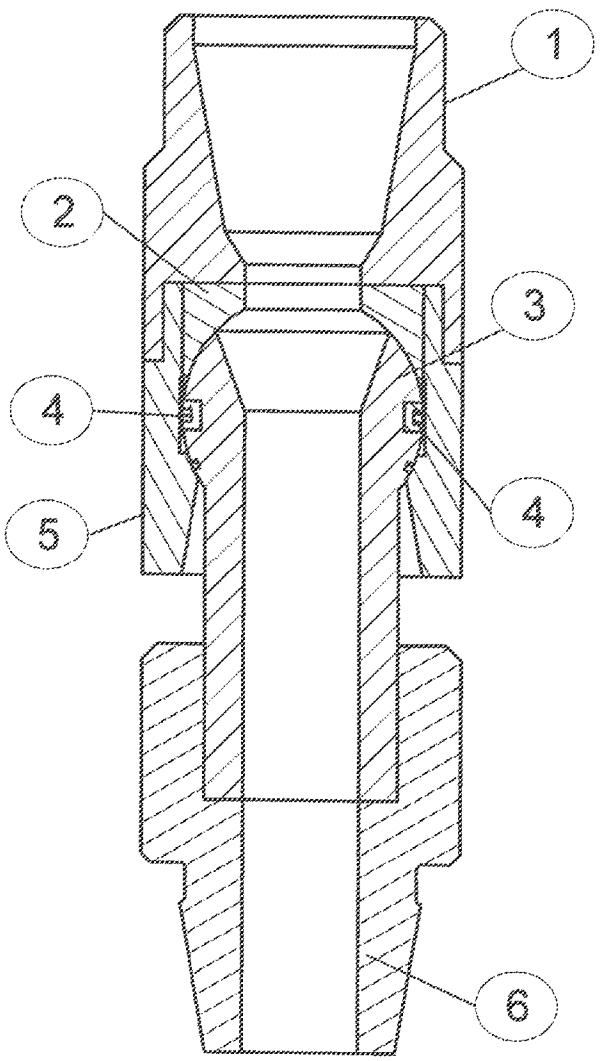
FIG. 5 shows a section view of section B-B of the apparatus.

FIG. 5 shows a cross-sectional view of the apparatus along the section B-B. This Figure differs from FIG. 4 in that it shows the position of the drive pin(s) 4.

Figure 7:
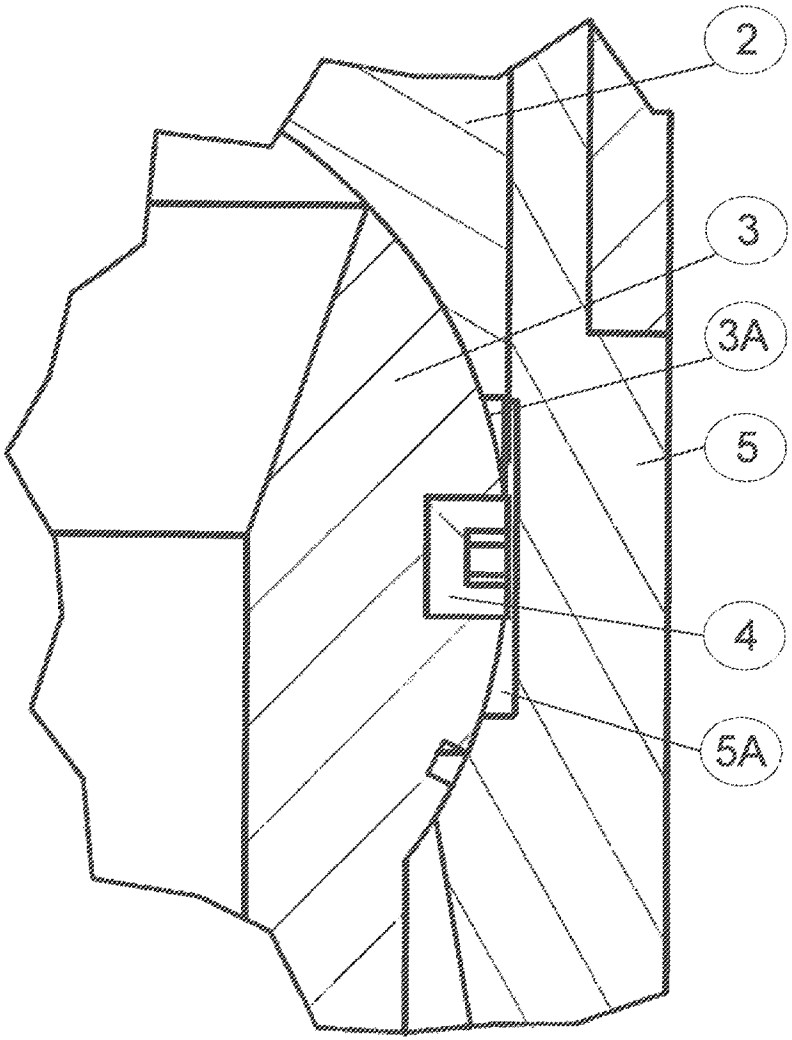
FIG. 7 shows the detail of section A from FIG. 6.
Figure 6:
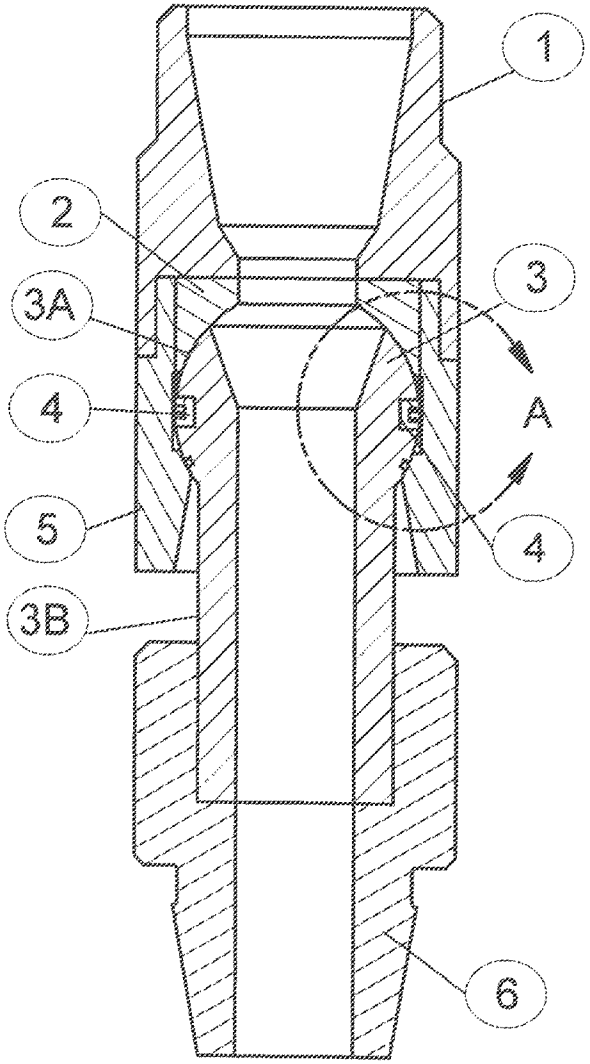
FIG. 6 shows the section view of FIG. 5 with a portion highlighted as section A.

A detailed section C is labelled in FIG. 6. This Figure also shows a cross-sectional view of the apparatus along the section B-B. FIG. 7 shows the detail of section C of FIG. 6 and, as can be seen in this Figure, the pivot joint seat 5 may include a drive pin recess 5A for receiving the drive pin(s) 4.

Figure 10:
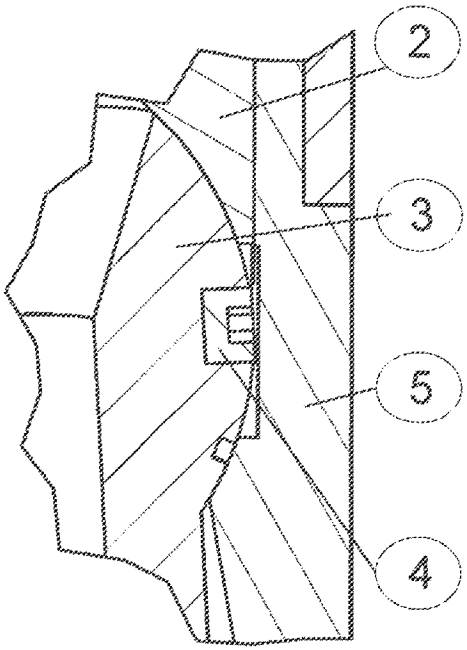
FIG. 10 shows, in detail, section A from FIG. 9.
Figure 9:
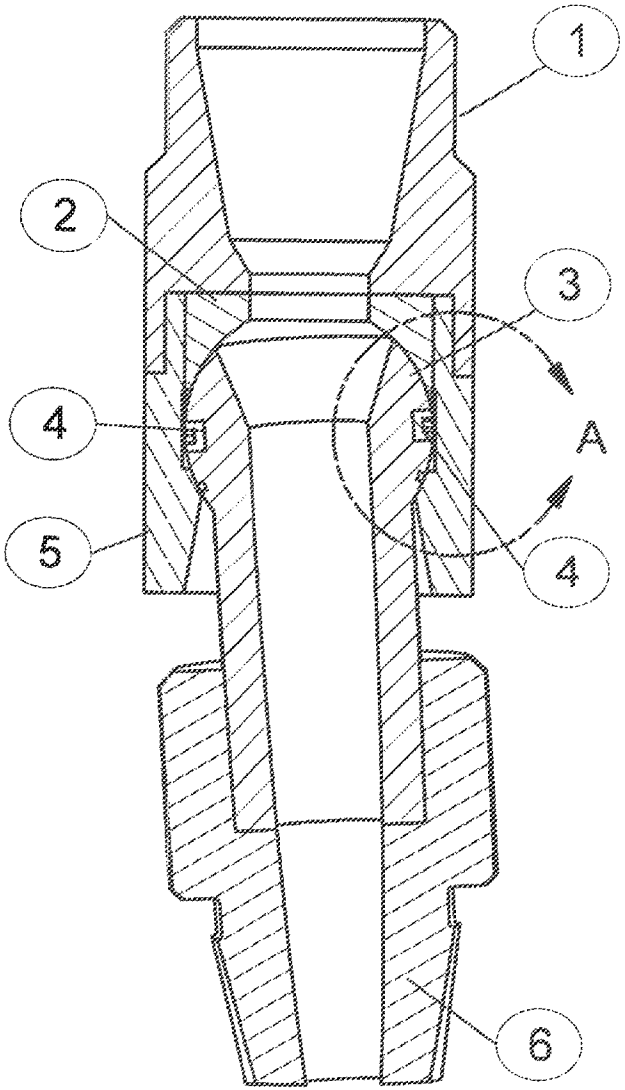
FIG. 9 shows the apparatus in a partially articulated state from the same perspective of that shown in FIG. 5, with a section view highlighted as section A.
Figure 8:
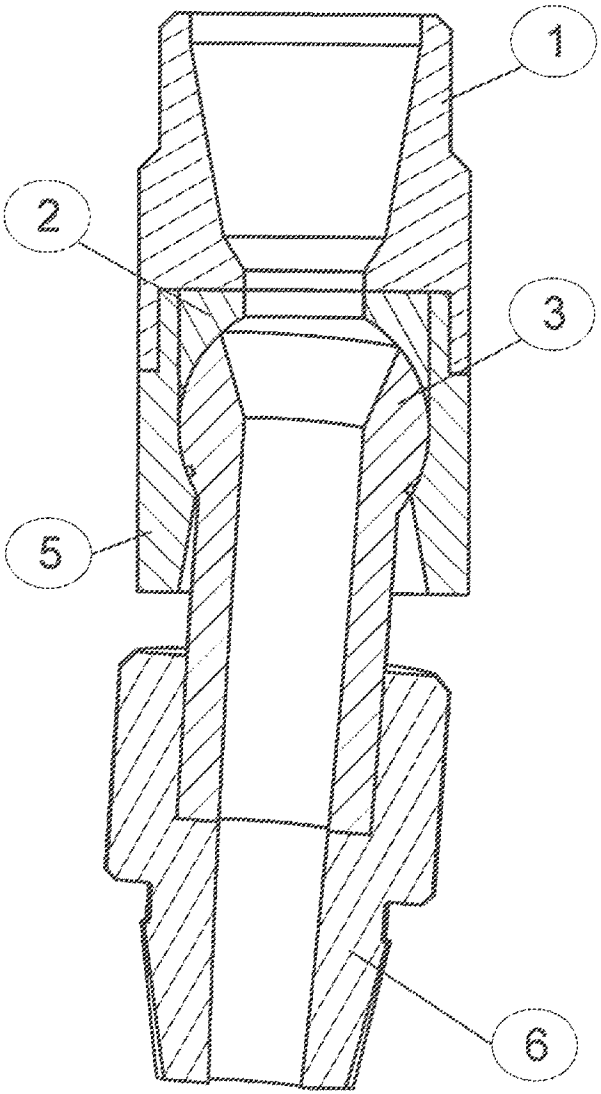
FIG. 8 shows the apparatus in a partially articulated state from the same perspective of that shown in FIG. 4.

FIGS. 8-10 show the apparatus of FIG. 2 in a partially articulated state. In FIGS. 8 and 9, it is shown how the pivot joint body 3 can freely articulate within the pivot joint seat 5. In FIG. 10, the drive pin 4 is shown in detail A from FIG. 9. Here it can be seen that the drive pin 4 moves in the recess of the pivot joint seat 5 to enable the free articulation of the pivot joint body 3 whilst maintaining the ability to transfer rotational torque through the apparatus from the box connection 1 to the pin connection 6.

Figure 11:
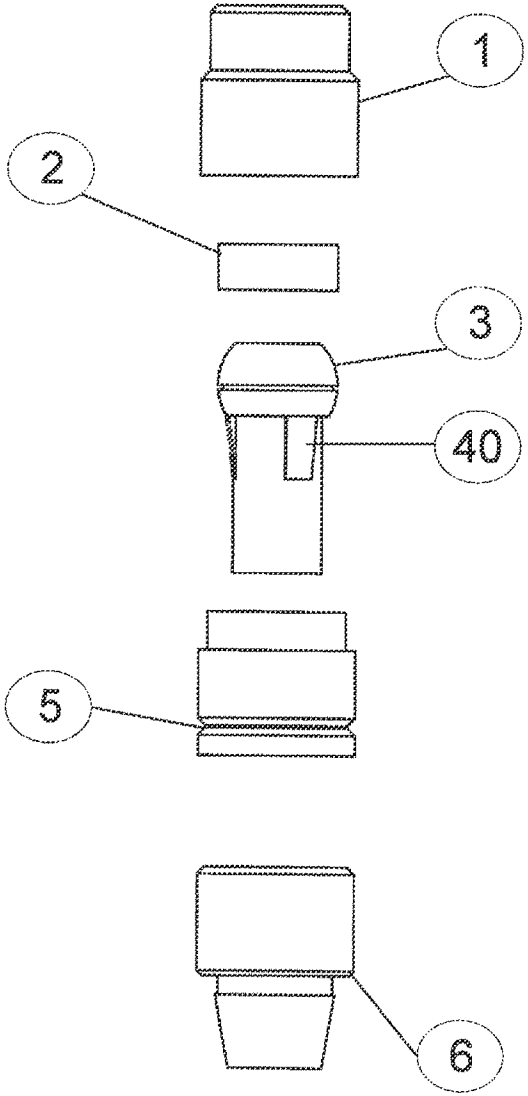
FIG. 11 shows an apparatus in an exploded view in accordance with a further embodiment of the present invention.

FIG. 11 shows an alternative embodiment of the present invention in that the apparatus differs from the apparatus of FIG. 1 by providing at least one spline portion 40 on the pivot joint body 3. The at least one spline portion 40 works in the same way as the drive pin(s) 4 described above. For example, the at least one spline portion 40 transfers rotational torque through the pivot joint body 3, and then through the pin connection 6.

Figure 12:
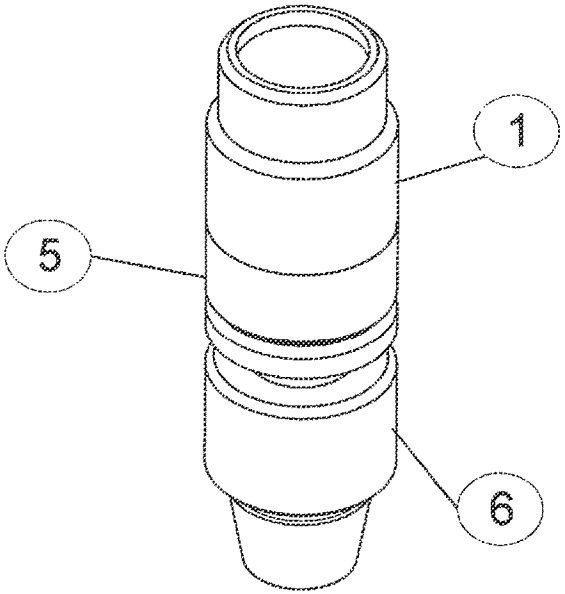
FIG. 12 shows the assembled apparatus of FIG. 11.

FIG. 12 shows an assembled apparatus of FIG. 11. As can be seen here, the box connection 1, retainer ring 2 (not visible), pivot joint body 3 (not visible), pivot joint seat 5 and pin connection 6 are all assembled together.

Figure 13:
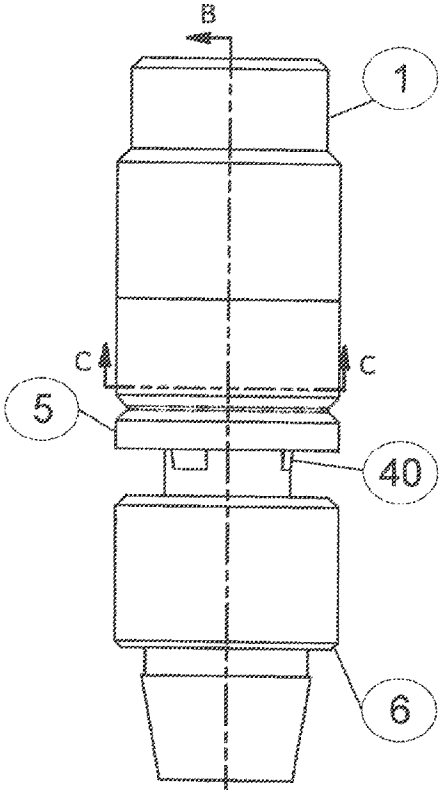
FIG. 13 shows a view of FIG. 12 with section views B-B and C-C labelled.
Figure 13A:
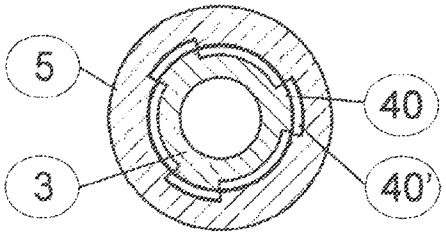
FIG. 13A shows a view of section C-C from FIG. 13.

FIG. 13 shows a side view of the apparatus of FIG. 12 with sections B-B and C-C labelled. FIG. 13A shows a view of section C-C. In FIG. 13A, it can be seen that the at least one spline portion 40 of the pivot joint body 3 engages a recessed groove 40' in an inner wall of the pivot joint seat 5. The recessed groove 40' is shaped to receive the at least one spline portion 40'. As is shown in this example, there is provided three spline portions 40 and three recessed grooves 40'. Of course, it is to be envisaged that there could be any number of splined portions 40 and recessed grooves 40'.

Figure 14:
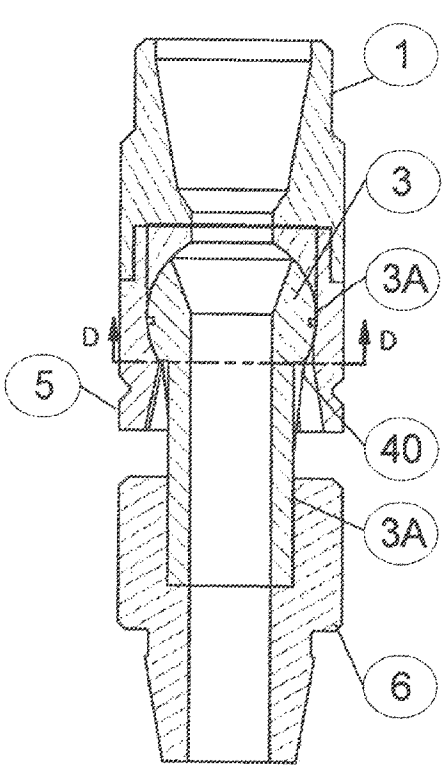
FIG. 14 shows a view of section B-B from FIG. 13 with a further section D-D labelled.
Figure 14A:
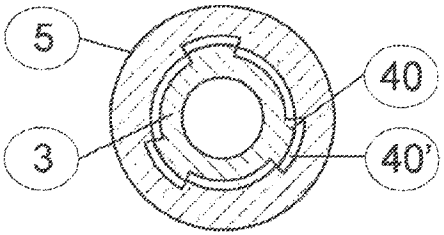
FIG. 14A shows a view of section D-D.

FIG. 14 shows a cross-sectional view of section B-B of the apparatus of FIG. 13. Here it can be seen that the pivot joint body 3 includes a head 3A and a body 3B—much the same as that described above in relation to FIG. 4. The at least one spline portion 40 is shown to be located within the pivot joint seat 5 and to be provided on the elongated body 3B. However, it is to be understood that at least a portion of the at least one spline portion 40 is engaged within a recessed groove 40' of the pivot joint seat 5. FIG. 14A shows the section D-D of FIG. 14. Here it can be seen, once again, that the at least one spline portion 40 engages with at least one recessed groove 40'. In the examples shown above, it is to be understood that the at least one spline portion 40 is a 'male' connector and the at least one recessed groove 40' of the pivot joint seat 5 is a 'female' connector—the 'male' connector being received by the 'female' connector.

Figure 15:
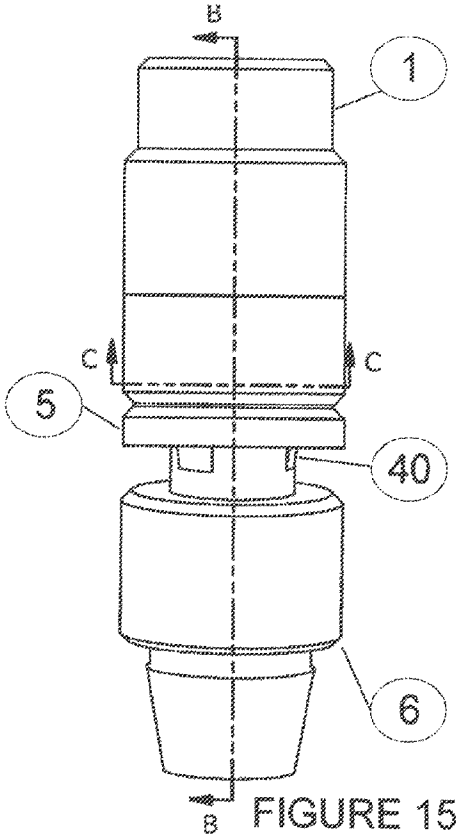
FIG. 15 shows a view of the apparatus of FIG. 12 in a partially articulated state with sections B-B and C-C labelled.
Figure 15A:
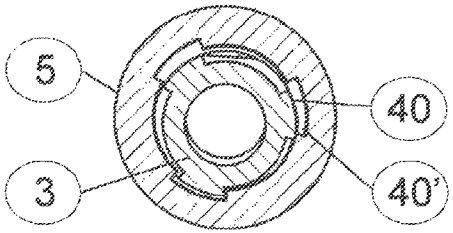
FIG. 15A shows a view of section C-C of FIG. 15.

FIG. 15 shows a view of the apparatus of FIG. 11 in a partially articulated state with sections B-B and C-C labelled. FIG. 15A shows a cross-section view of C-C of FIG. 15.

Figure 16:
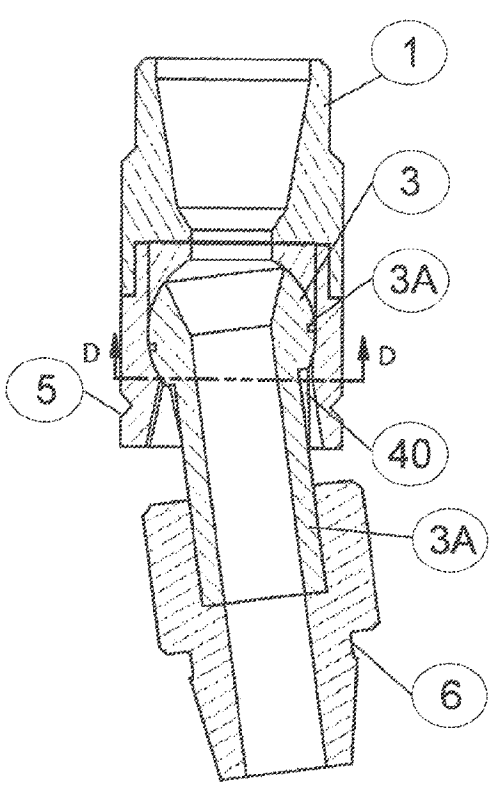
FIG. 16 shows a view of section B-B from FIG. 15 with a further section D-D labelled.

FIG. 16 shows a cross-section of section B-B of FIG. 13 when the apparatus is in a partially articulated state. As can be seen here, the pivot joint body 3 can articulate freely as discussed above. The at least one spline portion 40 transfers rotational torque through the pivot joint seat 5 by engaging with the at least one recessed groove 40', and then through to pin connection 6—in much the same way that the drive pin(s) 4 above transfer rotational torque.

Figure 16A:
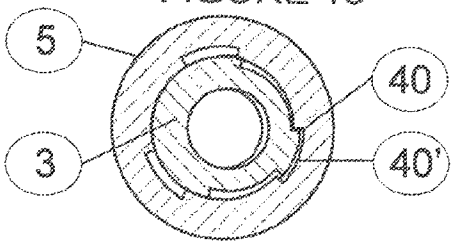
FIG. 16A shows a view of section D-D from FIG. 16.

FIG. 16A shows a cross-section of section D-D of FIG. 16. As shown in FIG. 16A, the at least one recessed portion 40' is shaped to receive the at least one spline portion 40. There is also provided a gap between the at least one spline portion 40 and the at least one recessed portion 40' to allow movement of the at least one spline portion 40. When the pivot joint body 3 freely articulates in the pivot joint seat 5, it is ensured that at least one spline portion 40 engages a respective recessed groove 40' to ensure that torque is transferred.

Figure 17A:
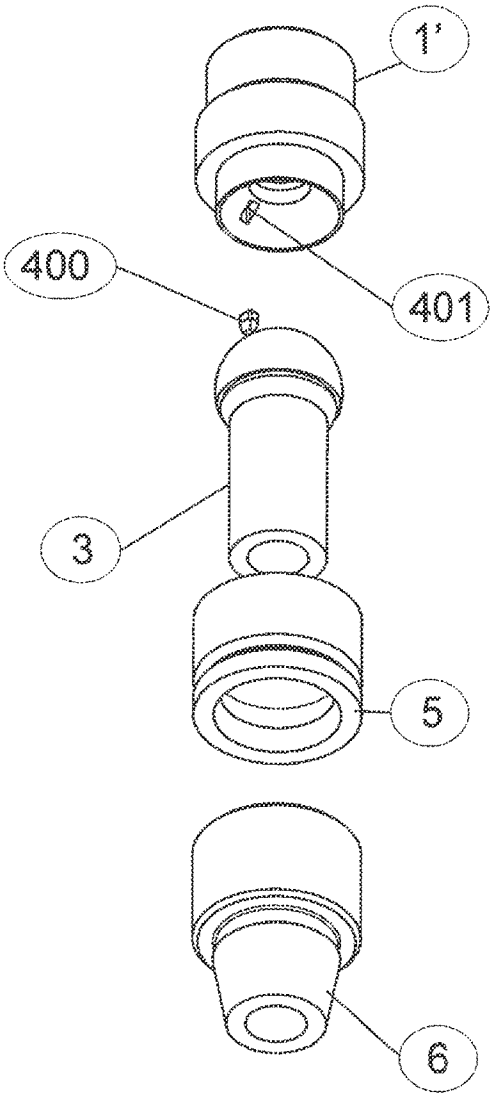
FIGS. 17 and 17A show an apparatus in an exploded view in accordance with a further embodiment of the present invention.
Figure 17:
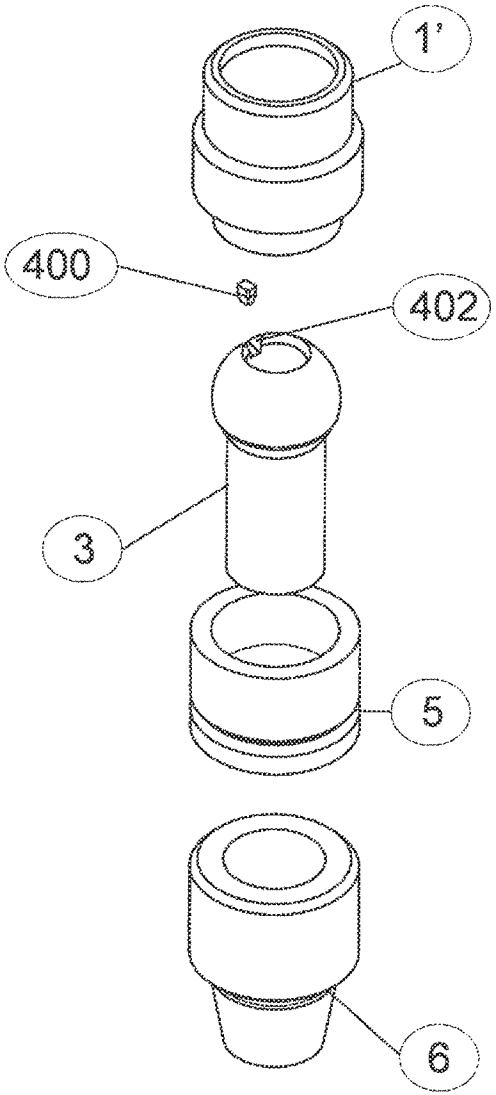

FIG. 17 shows an alternative embodiment of the present invention in that the apparatus differs from the apparatus shown in FIG. 1 and FIG. 11 by combining the box connection and retainer ring into a single component, hereinafter referred to as box connection 1' and providing at least one torque key 400 mounted within a machined receptacle 401 (as shown in FIG. 17A) within the box connection 1'. The at least one torque key 400 works in the same way as the drive pin(s) 4 or spline portion 40 described above. For example, the at least one torque key 400 transfers rotational torque through the pivot joint body 3, and then through the pin connection 6.

Figure 18:
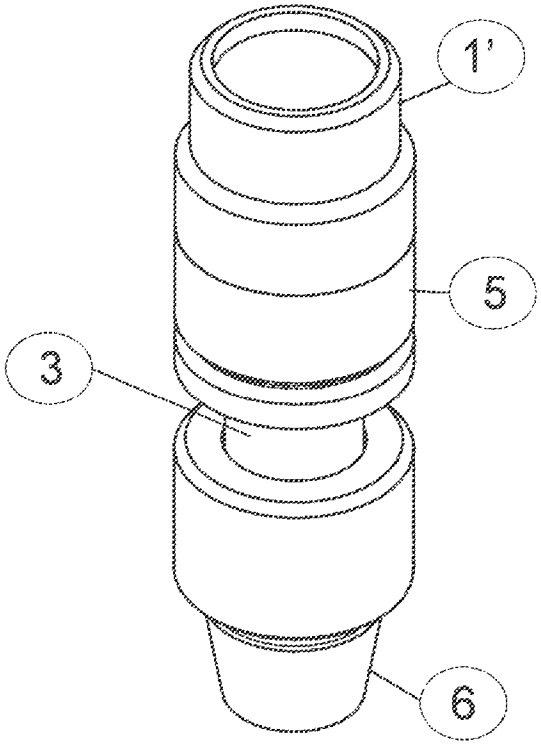
FIG. 18 shows the assembled apparatus of FIG. 17.

FIG. 18 shows an assembled apparatus of FIG. 17. As can be seen here, the box connection 1', pivot joint body 3, pivot joint seat 5 and pin connection 6 are all assembled together.

Figure 19A:
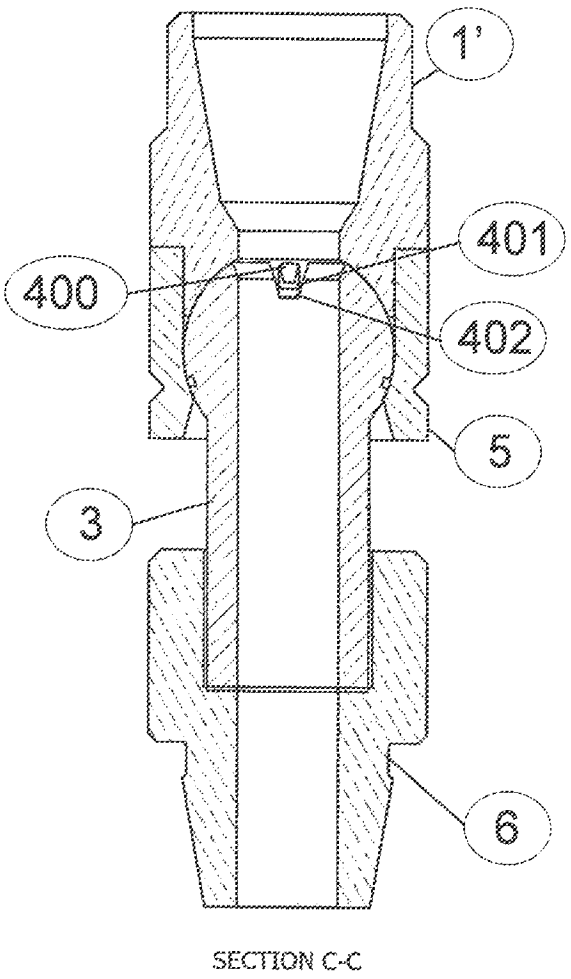
FIG. 19A shows a view of section C-C from FIG. 19.
Figure 19:
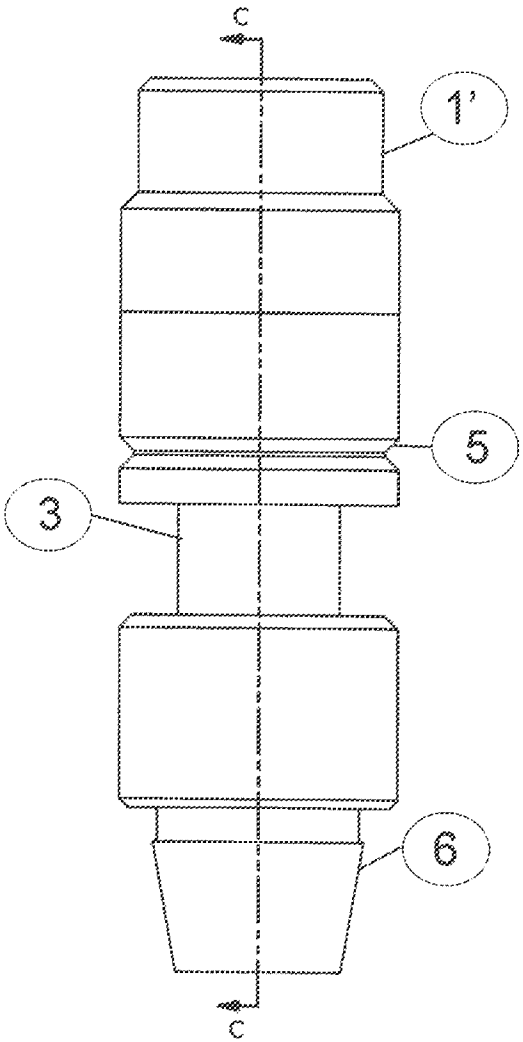
FIG. 19 shows a view of FIG. 18 with section C-C labelled.

FIG. 19 shows a side view of the apparatus of FIG. 18 with section C-C labelled. FIG. 19A shows a view of section C-C. In FIG. 19A, it can be seen that the at least one torque key 400 is mounted within the machined receptacle 401 within the box connection 1'. The torque key 400 engages a recessed groove 402 provided in the pivot joint body 3. The recessed groove 402 is shaped to receive the at least one torque key 400 whilst the pivot joint body 3 is partially pivoted relative to the box connection 1'. As is shown in this example, there is provided one torque key 400 and one recessed groove 402. Of course, it is envisaged that there could be any number of torque keys and recessed grooves.

Figure 20C:
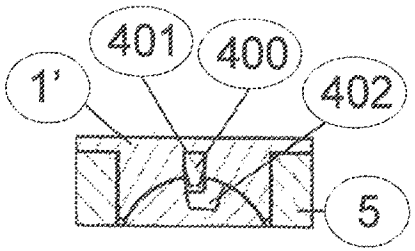
FIG. 20C shows a view of section H-H of FIG. 20B.
Figure 20B:
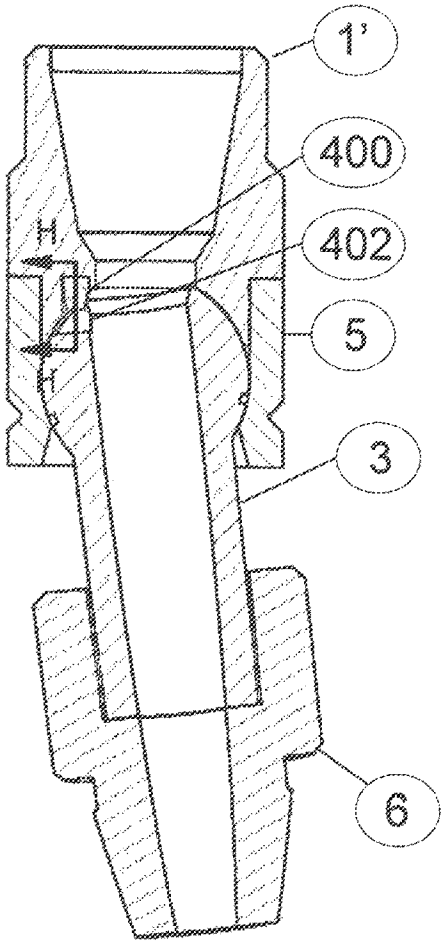
FIG. 20B shows a view of section F-F of FIG. 20A with a further section H-H labelled.
Figure 20A:
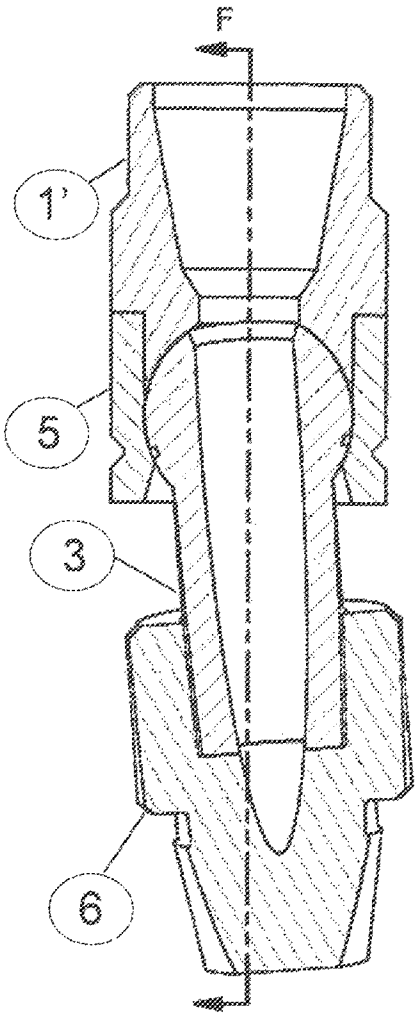
FIG. 20A shows a view of section E-E of FIG. 20 with a further section F-F labelled.
Figure 20:
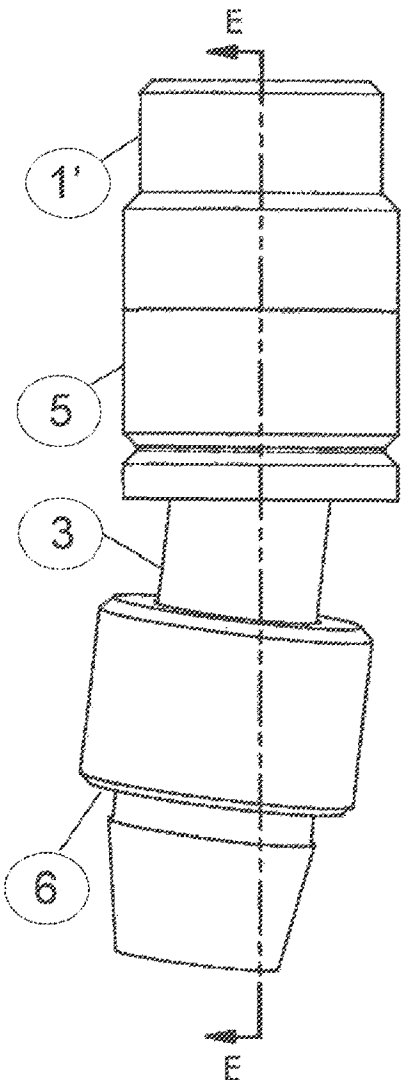
FIG. 20 shows a view of the apparatus of FIG. 18 whilst partially pivoted with section E-E labelled.

FIG. 20 shows a side view of the assembled apparatus of FIG. 17 whilst the apparatus is in a partially pivoted state with section E-E labelled. As can be seen here, the pivot joint body 3 can move freely as discussed above. The at least one torque key 400 transfers rotational torque through the pivot joint body 3 by engaging with the at least one recessed groove 402, and then through to pin connection 6—in much the same way that the drive pin(s) 4 or at least one spline portion 40 above transfer rotational torque.

FIG. 20A shows a cross-section of section E-E of FIG. 20 with a further section F-F labelled. As shown in FIG. 20A, the pivot joint body 3 is able to articulate into the recess of the pivot joint seat 5.

FIG. 20B shows a cross-section of section F-F with a further section H-H labelled. FIG. 20C shows a cross-section of section H-H. As shown in FIGS. 20B and 20C, the recessed groove 402 within the pivot joint body 3 is shaped to receive the at least one torque key 400 to allow movement of the pivot joint body 3. When the pivot joint body 3 freely articulates in the pivot joint seat 5, it is ensured that at least one torque key 400 engages a respective recessed groove 402 to ensure that torque can be transferred from the box connection 1' through to the pin connection 6 if desired.

Figure 21:
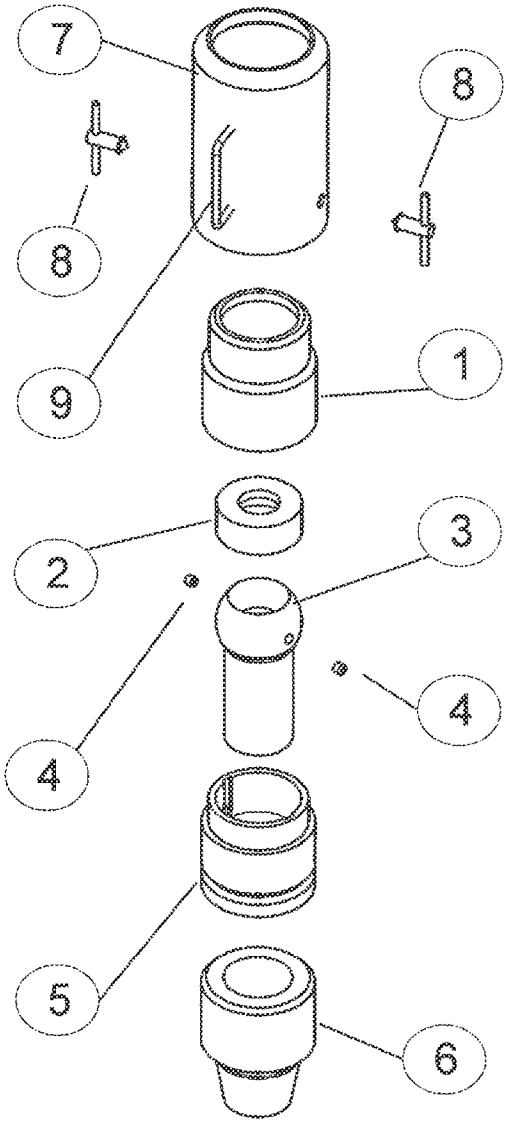
FIG. 21 shows a further aspect of the present invention and shows an exploded view of the components that provide a locking feature.

FIG. 21 shows a further aspect of the present invention. The above apparatus having been described in which there is an articulated joint between a work string/landing string and a casing or subsea infrastructure running tool. It is desirable to provide a locking mechanism that has the ability to lock the above apparatus—or any other articulated joint—in the rigid state (i.e., not articulated) at the discretion of the operator for the reasons of, but not limited to, transport, being stored in an upright orientation or in instances where weather conditions are sufficiently benign that using the tool in a flexible state is not preferred.

FIG. 21 shows an example of such a locking mechanism used in conjunction with the example articulation joints discussed above. FIG. 21 shows an exploded view of the components. As shown in FIG. 21, there may be provided a locking sleeve 7, a Remotely Operated Vehicle (ROV) locking pin, an ROV grab handle 9, the box connection 1, retainer ring 2, pivot joint body 3, pivot joint seat 5 and pin connection 6. The example of FIG. 21 shows the drive pin(s) 4 associated with FIGS. 1-10. However, it is to be understood that the locking mechanism shown in FIG. 21 can also be used in conjunction with the at least one spline portion 40 shown in FIGS. 11-16. The locking mechanism can also be used in conjunction with the torque key 400 shown in FIGS. 17-20.

The ability to lock the articulated joint in a rigid state is provided by the locking sleeve 7 being in a position isolating the pin connection 6 or the pivot joint body 3 against the internal diameter of the locking sleeve 7, therefore providing the ability to interfere and transfer bending moment through the apparatus described above via the box connection 1, locking sleeve 7 and pin connection 6 (or pivot joint body 3). The locking sleeve 7 is held in either a position of providing no transfer of bending moment through the articulated joint (such as those described above)—i.e., unlocked—or in a position of providing transfer of bending moment through the articulated joint (such as those described above)—i.e., locked.

As shown in FIG. 21, the locking mechanism comprises an ROV retractable locking pin 8 provided in a machined profile that receives the ROV retractable locking pin on either the pivot joint seat 5 or box connection 1. The ROV retractable locking pin 8 can be but is not limited to being operated by an ROV—for example, by rotation of a threaded barrel, or by a spring mechanism, or by any other means that allows for the locking pin 8 to be received or removed from the locking sleeve 7 at the discretion of the operator. The ROV retractable pin 8 and machined locating profile can be, but are not limited to, a triangular, square, circular or multi-sided sectioned profile. The mechanism that enables the retraction and deployment of the ROV retractable locking pin 8 may be but is not limited to being operated via spring load retraction or on a threaded barrel. For assistance in operating the ROV retractable locking pin 8, ROV grab handles 9 can be mounted on the locking sleeve 7.

Figure 23:
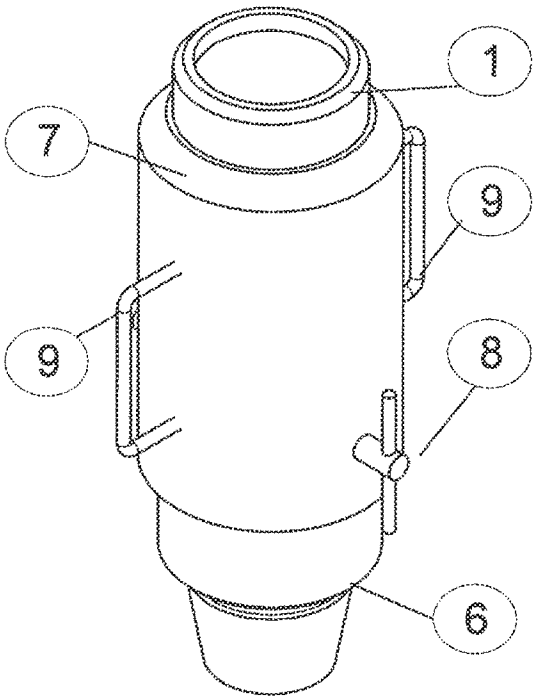
FIG. 23 shows an isometric view of the locking apparatus in a locked position.
Figure 22:
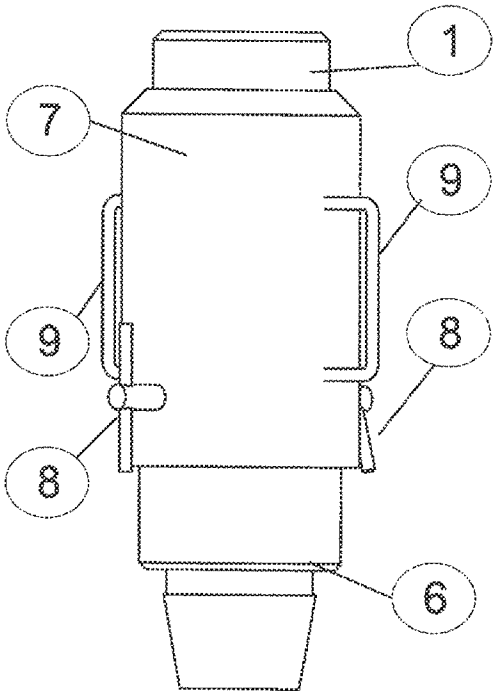
FIG. 22 shows an assembled view of the apparatus of FIG. 21.

FIGS. 22 and 23 show the locking mechanism, in use, in a locked position. As can be seen in these Figures, the locking sleeve 7 fits over the box connection 1, the pivot joint seat 5 and a portion of the pin connection 6. Of course, the locking sleeve 7 may fit entirely over the pin connection 6.

Figure 26:
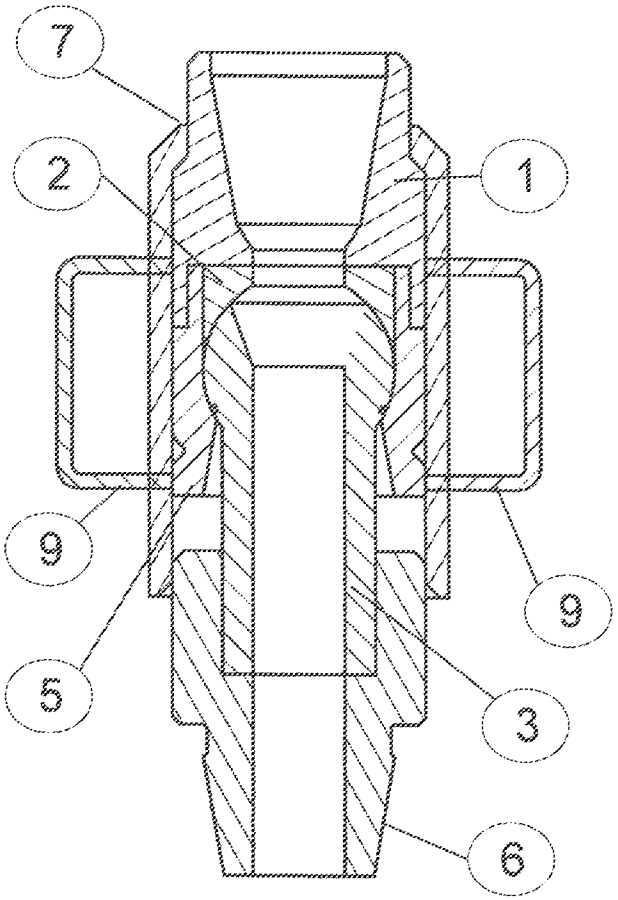
FIG. 26 shows a section view of section B-B of FIG. 24.
Figure 25:
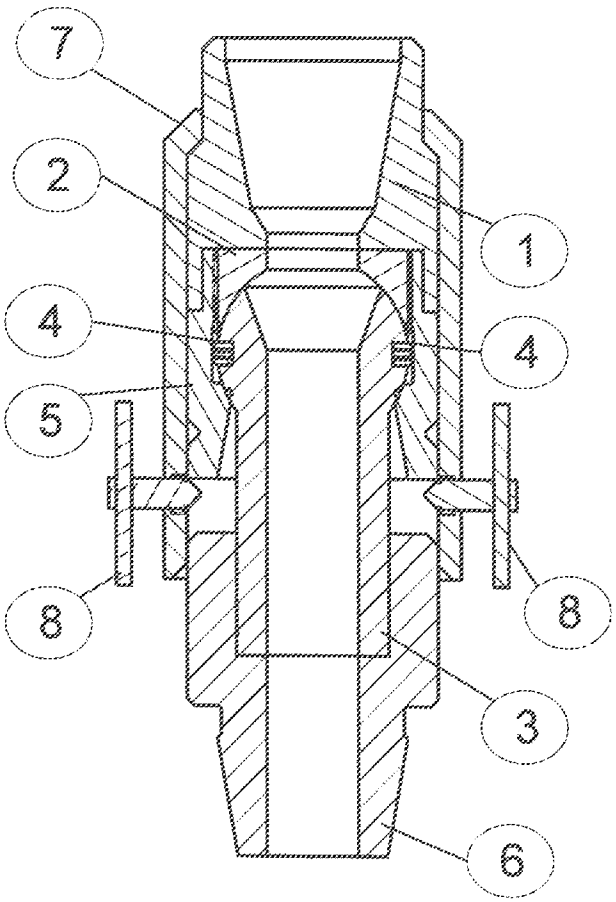
FIG. 25 shows a section view of section A-A of FIG. 24.
Figure 24:
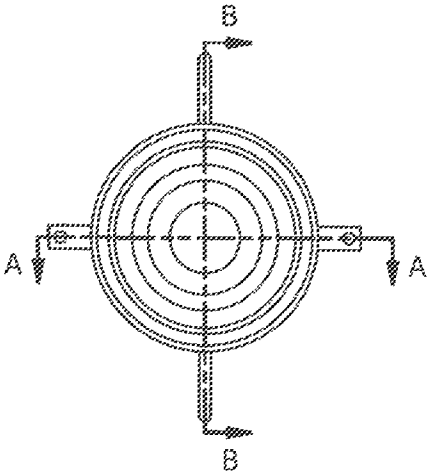
FIG. 24 shows the locking mechanism with the apparatus viewed from above in the locked position and sections A-A and B-B labelled.

FIG. 24 shows the locking mechanism from above with sections A-A and B-B labelled. FIGS. 25 and 26 show cross-sectional views of the apparatus described above (i.e., the articulated joint) with the locking mechanism included in the locked position. As shown in FIGS. 25 and 26, the locking sleeve 7 extends over, and engages with the pin connection 6 such that the apparatus described above (i.e., the articulated joint) cannot freely articulate. Note that rotational torque can still be imparted through the box connection 1 and through the apparatus to the pin connection 6.

Figure 27:
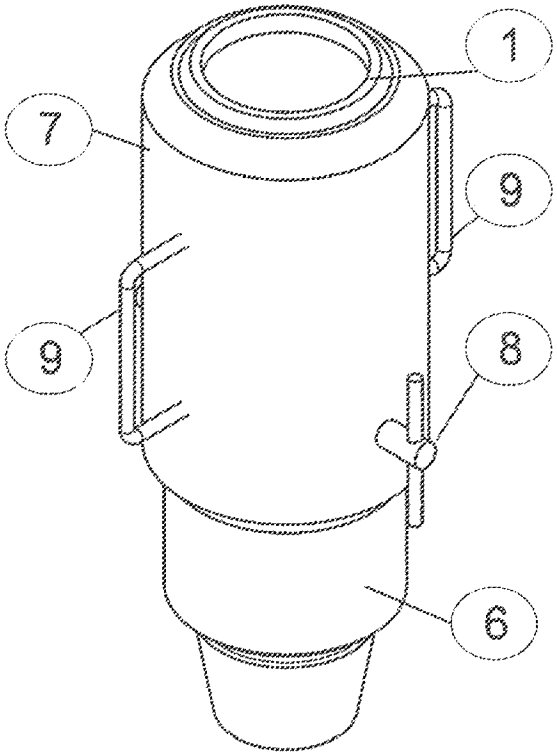
FIG. 27 shows an isometric view of the locking apparatus in an unlocked position.

FIG. 27 shows an isometric view of the locking sleeve 7 in an unlocked position.

Figure 29:
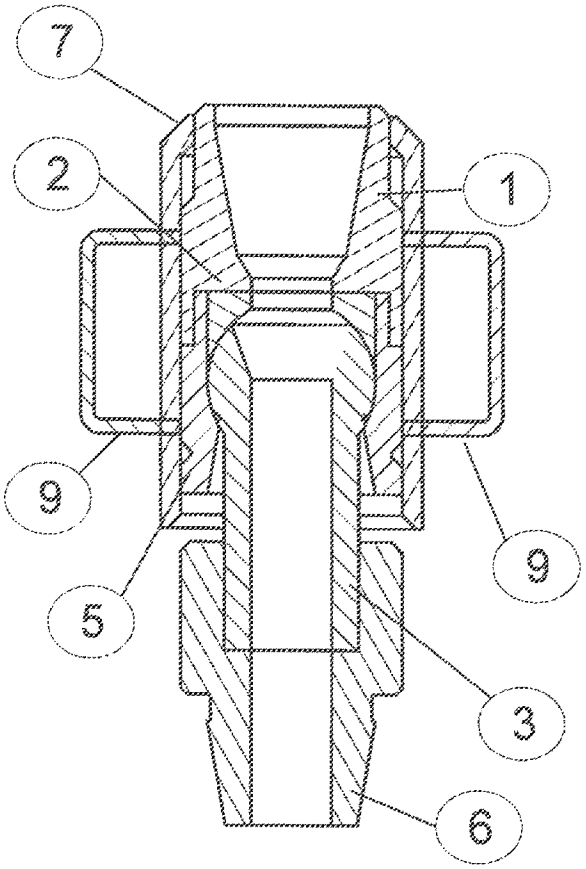
FIG. 29 shows a section view of section B-B of FIG. 24 in an unlocked position.
Figure 28:
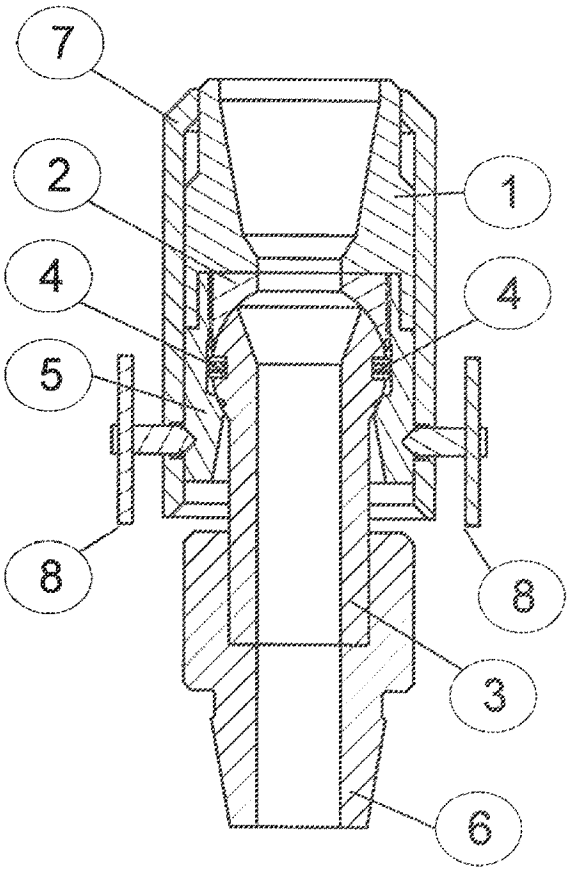
FIG. 28 shows a section view of section A-A of FIG. 24 in an unlocked position.

FIGS. 28 and 29 show cross-sectional views of sections A-A and B-B of FIG. 20 when the locking mechanism is provided on the apparatus described above in an unlocked state. As can be seen in FIGS. 28 and 29, the locking sleeve 7 does not extend over the pin connection 6 such that the apparatus described above (i.e., the articulated joint) and the pin connection can articulate freely within the pivot joint seat 5. Note that rotational torque can still be imparted through the box connection 1 and through the apparatus to the pin connection 6.

Figure 32:
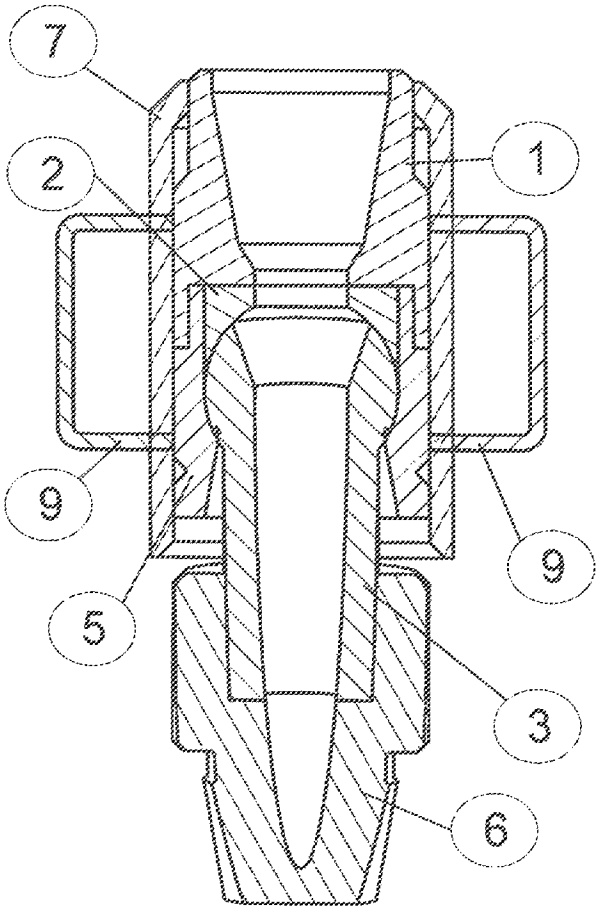
FIG. 32 shows a section view of B-B of FIG. 30.
Figure 31:
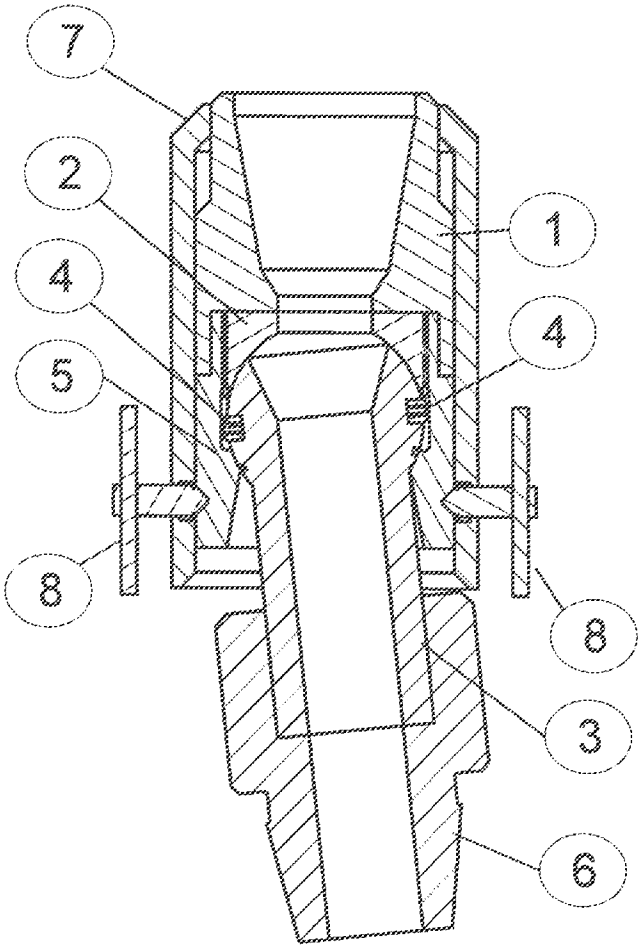
FIG. 31 shows a section view of A-A of FIG. 30.
Figure 30:
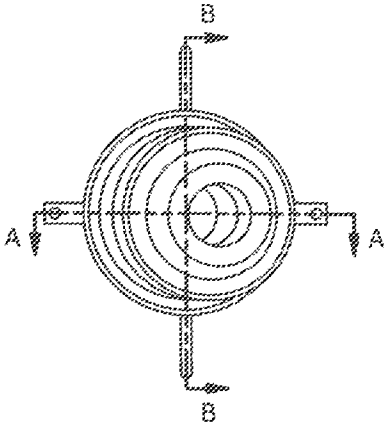
FIG. 30 shows a top view of the apparatus including a locking feature in an unlocked position and a partially articulated state. Sections A-A and B-B are also labelled in this Figure.

FIG. 30 shows a top view of the apparatus with a locking mechanism in an unlocked position and the articulated joint in a partially articulated state with sections A-A and B-B labelled. FIGS. 31 and 32 show cross-sectional views of the sections A-A and B-B, respectively. Here, it can be seen that, in an unlocked position, the pivot joint body 3 can articulate freely within the pivot joint seat 5.

It is to be understood that the locking mechanism described above and the apparatus could be provided in a kit.

In a preferred embodiment, the material of the apparatus and locking mechanism described above is steel. Of course, the box connection 1, the retainer ring 2, the pivot joint body 3, the drive pin 4, the spline portion 40, the pin connection 6, the locking sleeve 7, the ROV retractable locking pin 8 and the ROV grab handle 9 could be made of other materials, such as X56, L80, P110, S135, V150 (examples of various grades of steel) or any other grades of AISI steel, hardened plastics, carbon fibre or any other high strength metallic material such as titanium, aluminium etc. The seal mechanism to maintain pressure retaining ability between the internal and external of the apparatus can be any polymer or steel material to provide hydraulic sealing whilst the pivot joint body 3 is in various articulated positions within the pivot joint seat.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims.

The invention claimed is:

1. A kit comprising an apparatus for transferring rotational torque from or to a work string, the kit comprising: an articulated joint comprising: a first connection for receiving the work string;

a second connection for receiving subsea infrastructure tooling;

a joint seat located between the first connection and the second connection;

a joint body provided on the joint seat, wherein the joint body is connected to the second connection and the joint body can pivot freely within the joint seat;

means for transferring rotational torque from the first connection to the joint body and subsequently to the second connection; and a locking mechanism provided with the articulated joint; wherein the locking mechanism is suitable for reversibly locking the articulated joint; and wherein the locking mechanism comprises:

a sleeve configured to fit over the first connection and the joint seat; in a locked position the sleeve prevents the joint body from moving and in an unlocked position the sleeve allows the joint body to move freely.

2. The kit of claim 1, wherein the locking mechanism comprises a sleeve retainer configurable to hold the sleeve in at least one of the locked position and the unlocked position.

3. The kit of claim 2, wherein the sleeve retainer comprises at least one locking pin that is adapted to engage at least one of the joint seat and the joint body.

4. The kit of claim 3, wherein the locking mechanism further comprises at least one handle for operating the at least one locking pin.

5. The kit of claim 3, wherein at least one of the joint seat and the joint body comprises a machined profile on its outer surface for receiving the at least one locking pin.

6. The kit of claim 1, wherein, when in the locked position, the sleeve isolates at least one of the second connection and the joint body against an internal diameter of the sleeve, such that the joint body does not move freely.

7. The kit of claim 1, wherein the means for transferring rotational torque comprises a torque key provided in a receptacle located in the first connection and in a recessed groove located in the joint body.

8. A kit comprising:

an articulated joint comprising:

a first connection for receiving a work string;

a second connection for receiving subsea infrastructure tooling;

a joint seat located between the first connection and the second connection;

a joint body provided on the joint seat, wherein the joint body is connected to the second connection and the joint body can pivot freely within the joint seat;

means for transferring rotational torque from the first connection to the joint body and subsequently to the second connection; and a locking mechanism provided with the articulated joint;

wherein the locking mechanism is suitable for reversibly locking the articulated joint;

wherein the locking mechanism comprises:

a sleeve configured to fit over the first connection and the joint seat;

in a locked position the sleeve prevents the joint body from moving and in an unlocked position the sleeve allows the joint body to move freely, wherein the locking mechanism comprises a sleeve retainer configurable to hold the sleeve in at least one of the locked position and the unlocked position, wherein the sleeve retainer comprises at least one locking pin that is adapted to engage at least one of the joint seat and the joint body, wherein the locking mechanism further comprises at least one handle for operating the at least one locking pin, and wherein the at least one locking pin and the at least one handle are a Remote Operated Vehicle locking pin and a Remote Operated Vehicle handle.

9. The kit of claim 1, wherein the first connection, the second connection, the joint seat and the joint body collectively define an internal bore to facilitate passing of objects therethrough.

10. The kit of claim 9, wherein the internal bore has internal pressure retaining ability.

* * * * *